United States Patent [19]

Buchmüller

[11] 4,271,901

[45] Jun. 9, 1981

[54] OIL COOLER FOR AN INTERNAL COMBUSTION ENGINE

[75] Inventor: Günter Buchmüller, Wolfsburg, Fed. Rep. of Germany

[73] Assignee: Volkswagenwerk Aktiengesellschaft, Wolfsburg, Fed. Rep. of Germany

[21] Appl. No.: 79,493

[22] Filed: Sep. 27, 1979

[30] Foreign Application Priority Data

Oct. 5, 1978 [DE] Fed. Rep. of Germany ..... 2843423

[51] Int. Cl.[3] ..... F28F 3/10

[52] U.S. Cl. ..... 165/165; 123/41.33; 165/DIG. 23; 165/166

[58] Field of Search ..... 165/165, 166, 41, 51, 165/DIG. 23; 184/104 B; 123/41.33

[56] References Cited

U.S. PATENT DOCUMENTS

| | | | |
|---|---|---|---|
| 2,081,678 | 5/1937 | Rosenblad | 165/165 |
| 2,222,721 | 11/1940 | Ramsaur et al. | 165/165 X |
| 3,743,011 | 7/1973 | Frost | 165/167 X |
| 3,854,530 | 12/1974 | Jouet et al. | 165/163 |
| 4,058,980 | 11/1977 | Ahlen | 165/165 X |

FOREIGN PATENT DOCUMENTS 1551521 3/1973 Fed. Rep. of Germany .

*Primary Examiner*—Albert W. Davis
*Attorney, Agent, or Firm*—Brumbaugh, Graves, Donohue & Raymond

[57] ABSTRACT

An oil cooler for an internal combustion engine comprises a housing for containing a coolant and an axially disposed center fixing tube extending through the housing. A plurality of plate-like oil chambers are disposed within the housing, each being formed by a pair of oppositely profiled cooling plates. The oil chambers are spaced apart axially along the fixing tube so that the space between the oil chambers forms cooling channels for a coolant. An oil inlet and outlet extend parallel to the fixing tube and communicate with all the oil chambers for supplying and discharigng oil directly from all the oil chambers. The oil inlet and outlet, as viewed in cross-section, lie along radii from the central axis of the oil chambers which are at an acute angle relative to one another, and a partition extends radially in the acute angle between the inlet and outlet so that oil supplied to the oil cooler is directed tangentially around the fixing tube toward the outlet. Coolant inflow and outflow pipes are provided for introducing a coolant, through openings in the housing, into the cooling channels between the oil chambers. The coolant inflow and outflow openings are disposed relative to one another to form an acute angle, thereby to cause coolant introduced into the housing to flow through the cooling channels tangentially. The coolant inflow and outflow pipes and the oil inlets and outlets are arranged relative to one another so that oil and coolant introduced into the oil cooler flow in opposite directions.

9 Claims, 3 Drawing Figures

OIL COOLER FOR AN INTERNAL COMBUSTION ENGINE

BACKGROUND OF THE INVENTION

The present invention relates to an oil cooler having an axially disposed center fixing tube extending through the cooler housing and having oil chambers therein which are placed in thermal contact with a coolant.

Oil coolers of the type in which engine oil is placed in thermal contact with a coolant are known. One such oil cooler is disclosed in U.S. Pat. No. 3,743,011. An oil inlet and outlet are spaced axially so that oil flow occurs through a first group of oil chambers radially outwardly and back through a second group of oil chambers radially inwardly. A flow of coolant is directed tangentially, i.e. circumferentially, in heat exchange relation with the oil, such that the flow of the oil and coolant are perpendicular relative to one another.

In the cooling of oil contained in an oil cooler, optimum efficiency occurs if the flow direction of the oil and the coolant are opposed. U.S. Pat. No. 3,854,530 discloses oil cooler constructions in which the oil and coolant flow oppositely in tangential directions. The oil cooler includes radially spaced-apart flow deflecting walls wound in spiral shape and is a rather complex structure. This poses difficulties in manufacture, in particular relating to the end-face seals which are required, which can only be produced with great difficulty.

SUMMARY OF THE INVENTION

The present invention is an improved oil cooler in which a tangential flow of oil in the cooler is placed in heat exchange relation with a coolant flowing tangentially in the opposite direction.

More particularly, an oil cooler comprises a housing for containing a coolant with an axially disposed center fixing tube extending through the housing. A plurality of plate-like chambers are disposed in the housing, and each oil chamber is formed by a pair of oppositely profiled cooling plates which are spaced axially along the cooling tube. The space left between the oil chambers forms cooling channels for the coolant. An oil inlet and oil outlet extend parallel to the fixing tube for supplying and discharging oil directly to and from all of the oil chambers. The oil inlet and outlet are disposed within the housing to lie, in cross-section, along radii from the central axis of the fixing tube and thereby oil chambers which are at an acute angle relative to one another. Each of the oil chambers includes a radially extending partition, which may be formed by web-like oppositely directed profilings formed in the cooling plates between the oil inlet and outlet. Thus, oil supplied to the oil cooler housing is directed tangentially around the fixing tube toward the outlet since the partitions prevent the oil from short-cutting directly to the outlet. The housing also includes inflow and outflow ducts, which are offset axially relative to each other, for introducing coolant into the cooling channels through openings in the housing. The inflow and outflow are also offset circumferentially by an acute angle, that is, the inflow and outflow openings lie along radii from the central axis which form an acute angle relative to one another. Coolant introduced into the housing thereby flows tangentially through the cooling channels. Also the coolant inflow and outflow are oriented relative to the oil inlet and outlet so that the oil and coolant introduced into the oil cooler flow in opposite directions.

Preferably, the radial periphery of the cooling plates are spaced apart a distance from the housing such that the housing forms the outside container for the cooling medium. The housing includes an indentation between the acute angles between the inflow and outflow, which indentation preferably is radially co-extensive with the oil partitions, so that the housing is closely spaced at the indentation relative to the cooling chambers. This assists in assuring a tangential flow of the coolant around the fixing through the entire housing.

In the preferred embodiment of the invention, the oil chambers are closed on the inside by the fixing tube. The cooling plates have flanges on their inside edges which are directed toward the adjacent oil chamber. These flanges are tightly connected on the fixing tube and thus act as spacers between adjacent oil chambers.

Thus, the oil cooler according to the invention may be constructed by assembling rows of cooling plates, pairs of which form the plate-like oil chambers, for example, by positioning the plates on a fixing tube. The fixing tube may be provided with threads or the like for attaching the oil cooler onto the crankcase. The threads may also be used to fix an oil filter onto the outside of the cooler.

Preferably the oil cooler may be constructed from solder coated aluminum plates which after assembly are joined by heating. Such a process, for production of oil coolers from aluminum plates by soldering, is known per se from German published patent application No. 1,551,521. When solder clad aluminum plates are used to construct the cooler, the entire assembly may be completed with a single heating process optionally with the application of pressure.

The invention is relatively simple in construction, since the individual cooling plates are preferably shaped in a manner that when assembled onto the center fixing tube, they form tight oil chambers. When assembled in the oil cooler housing, the housing itself provides the outside seal for the cooling chambers formed between the plates. For ease of assembly, the housing can comprise two half shells which are joined tightly.

For a better understanding of the invention, reference is made to the following detailed description of a preferred embodiment of the invention, taken in accordance with the drawings accompanying the application.

DETAILED DESCRIPTION OF A PREFERRED EMBODIMENT

Figure 1:
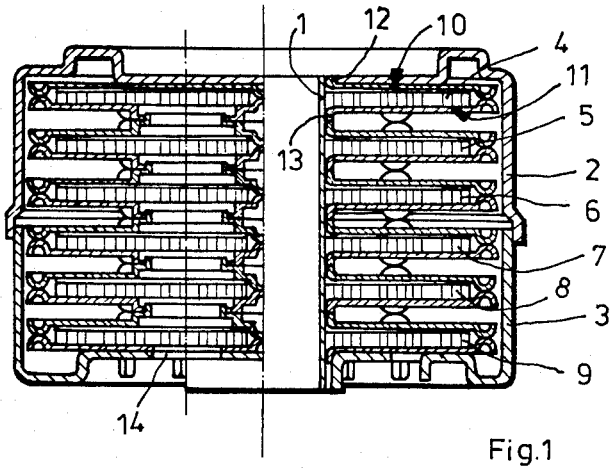
FIG. 1 is a longitudinal sectional view of an oil cooler taken through lines I—I of FIG. 2.

An oil cooler according to the invention has a housing formed of two half shells 2 and 3 which are joined (after assembly) tightly. A center fixing tube 1 is disposed in the housing 2, 3 and six plate-like oil chambers 4, 5, 6, 7, 8 and 9 are spaced apart axially along the fixing tube 1. Each oil chamber is formed by a pair of cooling plates, e.g. 10 and 11, each plate having an identical profile but assembled in opposite directions. Each of the cooling plates, e.g. 10 and 11 are tightly joined with the fixing tube 1 along flanges 12 and 13 facing in opposite directions, which thus seals off the oil chambers towards the inside. The flanges 12 and 13 also act as spacers between adjacent oil chambers. The space between each of the oil chambers serves to conduct a cooling medium, in this case the coolant of the internal combustion engine.

An oil inlet 14 extends vertically, parallel to the fixing tube, and communicates directly with all of the oil chambers 4 through 9. The oil inlet 14 is open towards the bottom and closed towards the top. On the other hand, an oil outlet 15 (shown in FIG. 2), which also extends parallel to the fixing tube 1 and connects all of the oil chambers 4 through 9, is closed off towards the bottom and open towards the top. Normally, then, the oil cooler is mounted above the engine crankcase so that engine oil introduced into the oil cooler through the inlet 14 flows through the oil cooler both around the cooling chambers and then in an upward direction out through the oil outlet 15. An oil filter (not shown) is attached to the fixing pipe 1 on the outside of the oil cooler, so that oil exiting from the outlet 15 flows into the oil filter and back down through the fixing pipe 1 back into the crankcase.

Figure 2:
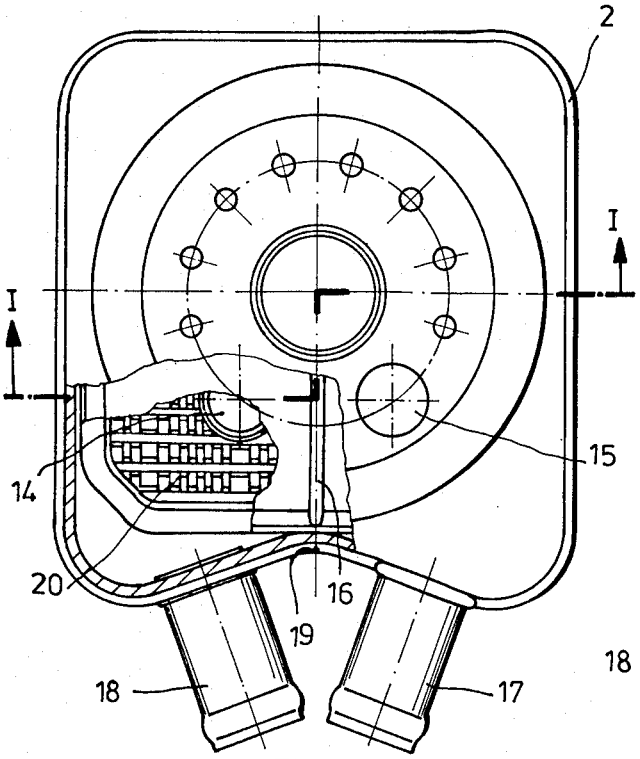
FIG. 2 is a top view partially in section of the oil cooler shown in FIG. 1.

As illustrated in FIG. 2, the oil inlet 14 and the oil outlet 15, in cross-section, lie along radii of the central axis of the oil chambers 4 through 9 which form an acute angle relative to each other. A radial partition, which is indicated as 16 for the uppermost oil chamber, extends in all oil chambers 4 through 9 between the acute angle formed by the inlet and outlet radii. The partition 16 is formed by web-like impressions in the cooling plates, e.g. 10 and 11. Oil entering the oil chambers 4 through 9 is forced, therefore, to flow through the oil chambers in a clockwise direction, and due to the acute angle at which the inlet 14 and outlet 15 are positioned, the oil is forced to flow around through essentially the entire volume of the oil chambers.

Figure 3:
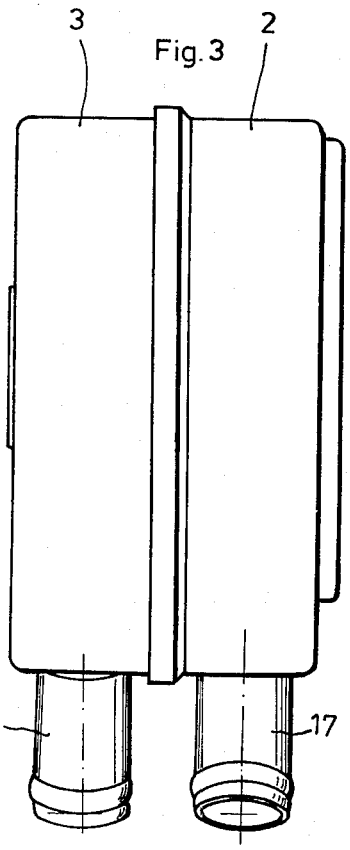
FIG. 3 is a side view of the oil cooler of FIG. 2.

Coolant is delivered to the oil cooler through an inflow pipe 17 and exits through an outflow pipe 18. The inflow and outflow pipes 17 and 18 communicate, through openings in the housing, with the interior of the oil cooler housing 2, 3, and are spaced apart axially relative to one another, as shown in FIG. 3. The openings for the inlet and outlet lie along radii from the central axis of the fixing tube 1 and thereby oil chambers which are at an acute angle relative to one another and within which, as shown clearly in FIG. 2, a portion of the housing 2, 3, e.g. along indentation 19, is closely spaced to the outer periphery of each oil chamber. The indentation 19 produces a division of the cooling chambers (between the oil chambers 4 through 9) so that the coolant is forced to flow through the oil cooler from the inflow pipe 17 counterclockwise towards the outflow pipe 18, thereby in a direction opposite the direction of the oil flow.

In the example of an embodiment represented, the acute angles between the oil inlet 14 and outlet 15 as well as the coolant inflow and outflow 17 and 18 substantially coincide so that the partitions 16 and the locus of the minimum distance (indentation 19) between the housing and the edge of the cooling plates are placed along one radius. As shown in FIG. 2, the oil inlet 14 is arranged adjacent to the coolant outflow duct 18, and the oil outlet 15 is adjacent to the coolant inflow duct 17, so that effective cooling of the oil is ensured in all parts of the oil cooler. Also, when the oil inlet 14 is open at the bottom, the coolant outflow duct 18 communicates with the bottom half 3 of the housing, and likewise the coolant inlet duct communicates with the top half 2 of the housing to correspond to the top-opening oil outlet 15, so that the oil inlet 14 and coolant outflow duct 18, and the oil outlet 15 and coolant inflow duct 17, respectively, are axially adjacent.

As shown in FIGS. 1 and 2, turbulence-producing plates are inserted within the oil conduits 4 through 9, one of which plates is indicated by 20 in FIG. 2. The plates 20 serve at the same time to stiffen the oil chambers in the direction of the fixing tube 1 (axially).

The invention offers a structurally simple and easy to manufacture oil cooler which, due to the oppositely directed oil and cooling medium flows, ensures optimal efficiency in all areas of the oil cooler. The oil cooler can readily be assembled from solder coated aluminum plates which are assembled onto the center fixing tube, and thereafter joined by a single heating process. Following the soldering process, the oil cooler can be flushed out in order to remove corrosion-causing residue. Since the oil cooler structure is composed of comparatively few parts, tolerances are easily maintained.

Although the invention has been shown and described with reference to a preferred embodiment thereof, it will be understood that variations and modifications of the device will be apparent to those skilled in the art while remaining within the inventive principles disclosed herein. All such modifications are intended to be within the scope of the invention as defined in the following claims.

I claim:

1. An oil cooler for an internal combustion engine comprising:

a housing having an axis;

an axially disposed center fixing tube extending through said housing;

a plurality of plate-like oil chambers within said housing, each said oil chamber being formed by a pair of oppositely profiled cooling plates and being spaced apart axially along said fixing tube, the space between said oil chambers forming cooling channels for a coolant;

oil inlet means extending parallel to said fixing tube for supplying oil directly to all said oil chambers;

oil outlet means extending parallel to said fixing tube for discharging oil directly from all said oil chambers, wherein said oil inlet means and said oil outlet means, in cross-section, lie along radii from the central axis of said fixing tube which are at a first acute angle relative to one another;

partition means in said oil chambers extending radially in the acute angular space between said oil inlet means and said oil outlet means for directing oil supplied to said oil cooler tangentially around said fixing tube toward said outlet means;

coolant inflow means for introducing a coolant through a first opening in said housing into the cooling channels between said oil chambers; and coolant outflow means for exhausting coolant through a second opening in said housing, said outflow means being offset axially relative to said coolant inflow means, wherein said first and second openings lie along radii from said central axis which are at a second acute angle relative to one another for causing coolant introduced into said housing to flow through said cooling channels tangentially, and wherein said coolant inflow and outflow means and said oil inlet and outlet means are arranged relative to each other for causing oil and coolant introduced into said oil cooler to flow in opposite directions.

2. An oil cooler according to claim 1, wherein said cooling plates have radial periphery which are spaced apart from said housing and said housing forms a container for said coolant.

3. An oil cooler according to claim 2, wherein said housing in the area between the acute angle formed by said inflow and said outflow has a portion which is closely spaced to said periphery.

4. An oil cooler according to claim 3, wherein said portion is substantially radially co-extensive with said partition means.

5. An oil cooler according to claim 3 or 4, wherein said portion comprises an indentation in said housing.

6. An oil cooler according to claim 1, wherein said partition means comprise web-like oppositely directed profilings in said cooling plates.

7. An oil cooler according to claim 1, wherein said oil inlet means is open at one end for communicating with an oil supply, said oil outlet means are open at one end for discharging oil, said openings lying axially at opposite ends of said housing, and wherein said coolant outflow means are disposed axially adjacent said oil inlet means and said coolant inflow means are disposed axially adjacent said oil outflow means.

8. An oil cooler according to claim 1, wherein said cooling plates have flanges which are directed toward an adjacent oil chamber and wherein said flanges form spacers between said oil chambers for defining said cooling channels, and wherein said flanges are tightly fixed on said fixing tube, said fixing tube thereby defining the inside of said oil chambers.

9. An oil cooler according to claim 1, wherein said oil cooler is formed from solder coated aluminum plates joined by heat.

* * * * *